United States Patent [19]

Wilson

[11] 4,047,710

[45] Sept. 13, 1977

[54] FRAMING FORM AND CLAMP

[76] Inventor: John Wilson, 708 S. Higgins, Missoula, Mont. 59801

[21] Appl. No.: 748,366

[22] Filed: Dec. 7, 1976

[51] Int. Cl. ..... B25b 1/20

[52] U.S. Cl. ..... 269/42; 269/108; 269/112

[58] Field of Search ..... 269/41–42, 269/130–132, 108–109, 112

[56] References Cited

U.S. PATENT DOCUMENTS

| | | | |
|---|---|---|---|
| 744,555 | 11/1903 | Jacobs | 269/112 |
| 840,777 | 1/1907 | Lawson | 269/112 |
| 1,221,601 | 4/1917 | Rowland | 269/112 |
| 2,816,342 | 12/1957 | Hyre | 24/269 |
| 3,574,342 | 4/1971 | Berns | 254/79 |
| 3,590,458 | 7/1971 | Day | 269/112 |
| 3,762,696 | 10/1973 | Falk et al. | 269/108 |
| 3,944,200 | 3/1976 | Huntley | 269/42 |

FOREIGN PATENT DOCUMENTS

| | | | |
|---|---|---|---|
| 137,258 | 12/1902 | Germany | 269/108 |

*Primary Examiner*—Robert C. Watson
*Attorney, Agent, or Firm*—Fleit & Jacobson

[57] ABSTRACT

A framing form and clamp includes a support or base having a plurality of guideways for mounting framing blocks. A belt cooperating with a ratchet assembly surrounds the blocks. In forming and clamping a frame, frame molding strips are associated with the appropriate framing blocks of the framing form and clamp, the size and number of the strips depending upon the dimension and shape of the desired frame. The belt is tightly wound around the framing blocks to secure the strips while the corners of the adjacent strips are permanently connected to form the frame.

16 Claims, 1 Drawing Figure

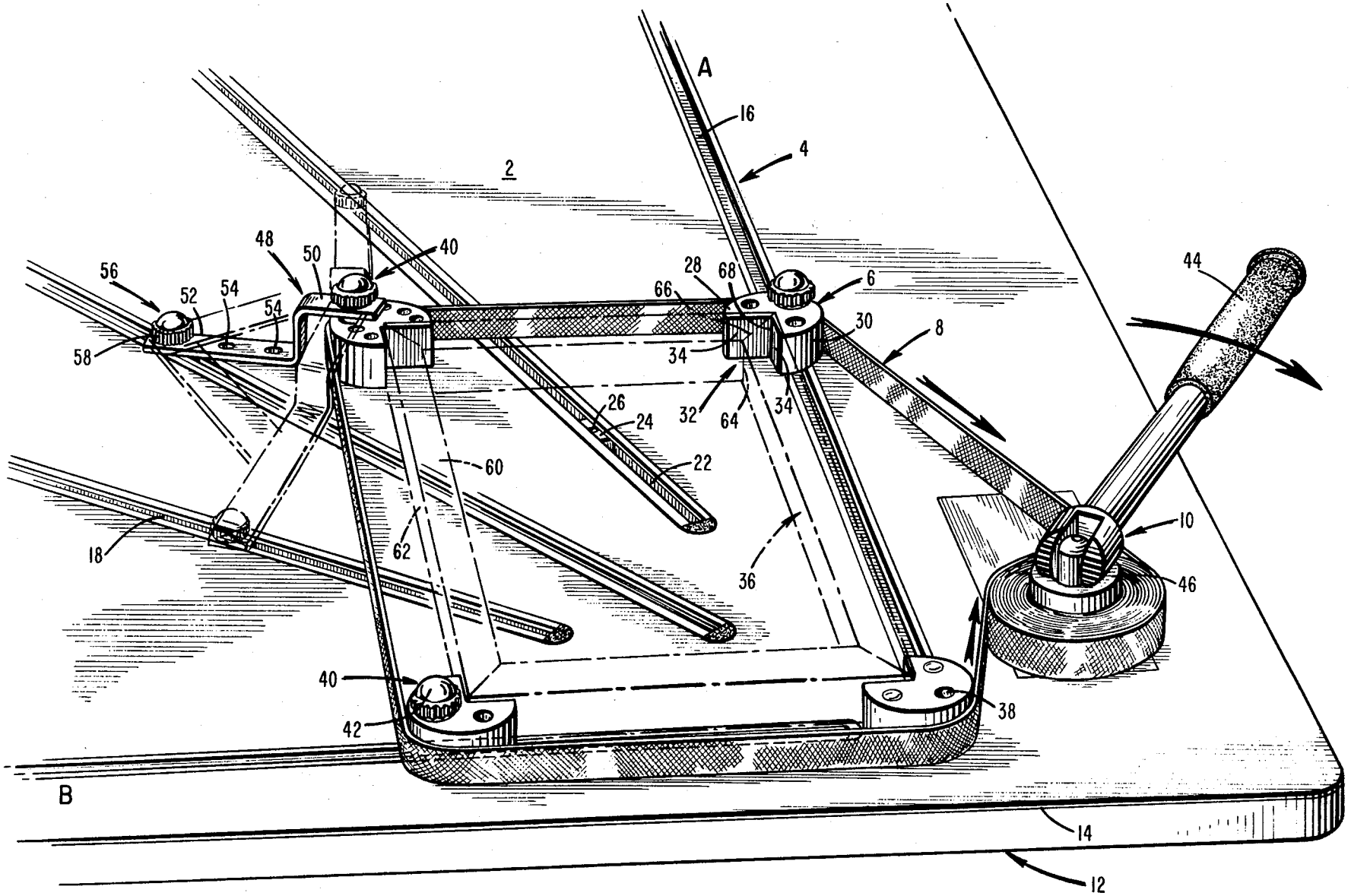
44
10
46
14
12
38
8
6
30
4
16
A
34
36
68
64
28
32
66
22
24
26
2
60
40
62
42
50
48
54
52
56
58
18
B

FRAMING FORM AND CLAMP

BACKGROUND OF THE INVENTION

The present invention relates to a framing form and clamp. More particularly, this invention relates to a framing form and clamp which simplifies clamping of frame molding strips and enables quick and easy forming of any polygonal frame.

There are many devices for forming a frame from molding strips. However, these devices are complicated in design and construction and cannot quickly and easily be used for joining moulding strips to form frames of any desired polygonal shape.

Accordingly, an object of the present invention is to provide an improved framing form and clamp.

A further object of the present invention is to provide a framing form and clamp which can form and clamp a frame of any dimension or shape.

A still further object of the present invention is to provide a framing form and clamp which can be quickly and easily operated to form and clamp a frame.

Yet another object of the present invention is to provide a framing form and clamp which can be economically manufactured.

Still further objects of the present invention will become apparent upon reading the following description taken in conjunction with the appended claims.

SUMMARY OF THE INVENTION

The present invention is broadly directed to a framing form and clamp which simplifies the forming of any polygonal frame. The invention includes a support or base, a plurality of guideways in the base, framing blocks slidably mounted to the guideways, and means for tightly securing the framing blocks around frame molding strips to form and clamp a frame.

In the preferred embodiment of the invention, the slidably mounted framing blocks are mounted to metal channels or tracks inset in the base by any suitable means such as threaded members inserted through a bore in each block and threadedly received in slidable supports in the channels either directly or by means of a Z-bracket or the like. Also, in the preferred embodiment, the means for securing the blocks around the frame molding strips includes a belt surrounding the blocks and a ratchet assembly connected to the belt. The ratchet assembly is used to tighten the belt around the blocks and bring the blocks into engagement with the frame molding strips to firmly secure the same for the purpose of forming and clamping a frame.

In accordance with the invention, the blocks are mounted to the appropriate channels, depending upon the desired shape of the frame. The belt is wrapped around the blocks and the frame molding strips are placed within the confines of the blocks so that the ends of the molding strips (i.e., the corners of the frame) are in contact with the blocks. The belt is then tightened around the blocks by the ratchet assembly so as to firmly clamp the molding strips. In conjunction with the above clamping operation, any conventional means is utilized to permanently attach the ends of the molding strips to form a frame.

BRIEF DESCRIPTION OF THE DRAWING

The FIGURE is a perspective view of a preferred embodiment of the framing form and clamp of this invention.

DESCRIPTION OF THE PREFERRED EMBODIMENT

Referring to the FIGURE, the framing form and clamp includes support or base 2, channels 4, framing blocks 6, belt 8 and ratchet assembly 10. Base 2 may be constructed from any suitable material. As illustrated, base 2 comprises a particle board 12 having a mar resistant sheet 14 laminated thereto. Base 2 may be of any size, the exact size depending upon the size of the frames being formed and clamped.

A plurality of guideways or channels 4 are inset in grooves formed in base 2, the angle and number of channels 4 depending upon the shape of the frames to be formed and clamped. For example, if triangular frames were the only frames to be formed, only two channels 4 would be required. However, since the framing form and clamp will normally be used to form and clamp a variety of frame shapes, a plurality of channels 4 such as illustrated will be provided in base 2.

Channels 4 are defined by tracks 16 and parallel side walls 18 in which parallel walls 18 terminate at their upper edges in flanges 20 extending toward each other and creating opening 22. Channels 4 may be of any length and may be constructed of any suitable material such as metal, plastic or nylon.

Disposed within guideways 4 are slidable block supports 24 of any suitable configuration such as a rectangular block. Each rectangular support 24 includes a threaded bore 26 which is adapted to receive a threaded member 40 or 56 through opening 22.

The slidably mounted framing blocks 6 are illustrated as three-quarter cylindrical blocks in the FIGURE which are suitable for forming 90° corners. Framing blocks having other shapes would be used in forming different angled corners. Referring to the FIGURE, blocks 6 include top surface 28, side wall 30, a bottom surface (not shown) and cut-out section 32 which is defined by walls 34 which contact the corners of frame moulding strips 36 to clamp and form the frame. Blocks 6 may be constructed from any suitable material such as metal or rubber (e.g., nylon).

Each block 6 also includes a plurality of bores 38, perpendicular to top surface 28 and extending the length of block 6. Received within one of the bores 38 of each block 6 is a threaded member 40 which includes enlarged head 42 and an elongated threaded shaft (not shown) of greater length than bore 38 which can be threaded into bore 26 of support 24 to hold a block 6.

Additionally, a Z-bracket 48 can be utilized to hold a block 6 when the dimensions of a frame other than those available with channels 4 are required. The upper horizontal section 50 of bracket 48 includes an opening (not shown) wherein bracket 48 can be attached to a block 6 by threaded member 40. The lower horizontal section 52 is elongated and includes a plurality of openings 54 wherein bracket 48 can be mounted to a channel 4 by inserting a threaded member 56 through an opening 54 where it is threadedly received in bore 26 of support 24. Member 56, like members 40, includes an enlarged head 58 but a shorter threaded shaft (not shown).

The framing form and clamp also includes a conventional ratchet assembly 10 mounted on base 2 and having handle 44 and vertical spindle 46. Ratchet assembly 10 is used to tighten web belt 8 around blocks 6 to clamp and form a frame. As will be appreciated, ratchet assembly 10 is only illustrative of various mechanisms which can be employed to tighten the web belt.

Turning now to the operation of the framing form and clamp, threaded members 40 are inserted in a bore 38 of each block 6 being utilized and threaded into the bore 26 of each support 24 in the appropriate channels such that blocks 6 are slidably mounted relative to channels 4. The number of blocks utilized and the appropriate channels 4 employed depend upon the desired shape of the frame. For example, a four-sided frame is illustrated in the FIGURE wherein two blocks 6 are mounted in Channels A and B. The third block 6 is held by Z-bracket 48 in which bracket 48 is attached to block 6 by threaded member 40 being inserted through the opening in section 50 of bracket 48 and through a bore 38 of block 6. Section 52 of bracket 48 is attached to a channel 4 by threaded member 56 being inserted through an opening 54 in section 52 and threaded into bore 26 of support 24 such that bracket 48 is slidably mounted relative to channel 4. The fourth block 6, which is positioned immediately adjacent ratchet assembly 10, may be slidably mounted in a channel 4 or permanently fixed on base 2.

Referring to the FIGURE, frame molding strips 36 are joined to form a frame. Molding strips 36 typically include top surface 60 and side wall 62 fixed at a predetermined angle to each other, such as a right angle. The frame is formed by placing molding strips 36 into the framing form and clamp so that side walls 62 are adjacent to and abutting walls 34 of cut-out section 32 of blocks 6 and so that ends 64 of adjacent side walls 40 and angled ends 66 of adjacent top walls 38 are contacting each other and properly positioned by corner 68 of section 22.

After placing molding strips 36 into the appropriate sections 22 of blocks 6, the free end of web belt 8 is wrapped around cylindrical blocks 6 and then inserted between the belt wrapped around spindle 46 and the belt extending therefrom, whereupon web belt 8 is tightened around cylindrical blocks 6 by ratchet assembly 10 so as to clamp and form a frame. In wrapping the belt 8 around block 6 held by bracket 48, belt 8 is wrapped between bracket 48 and block 6. The corners of the frame may then be permanently connected by any suitable means such as glue or the like.

While one embodiment of the present invention has been described above, it will be appreciated that there are many modifications and changes which can be made within the scope of the present invention. Accordingly, the present invention should not be limited by the specific embodiment illustrated, but only as defined in the appended claims.

I claim:

1. A framing form and clamp, comprising:
a base;
a plurality of guideways in said base;
framing means slidably mounted to said guideways;
bracket means having a first end slidably mounted to at least one of said guideways and a second end connected to one of said framing means for positioning said one of said framing means between said guideways; and
means for tightly securing said framing means around frame molding strips to clamp and form a frame.

2. The framing form and clamp of claim 1 wherein said slidably mounted framing means includes blocks having bores extending the length of said blocks, and attaching means for slidably mounting said blocks in said guideways.

3. The framing form and clamp of claim 2 wherein said bracket means comprises a Z-bracket.

4. The framing form and clamp of claim 2 wherein said attaching means includes an elongated threaded member and a slidable support in said guideway wherein said member is inserted through a bore of said block and threadedly received in said support.

5. The framing form and clamp of claim 1 wherein said means for tightly securing said slidably mounted framing means around frame molding strips includes a belt surrounding said blocks and means connected to said belt for tightening said belt around said blocks.

6. The framing form and clamp of claim 5 wherein said belt is a web belt.

7. The framing form and clamp of claim 5 wherein said tightening means is a ratchet assembly.

8. A framing form and clamp, comprising:
a baseboard;
a plurality of channels in said baseboard;
blocks slidably mounted to said channels;
a bracket having a first end slidably mounted to at least one of said channels and a second end connected to one of said blocks for positioning said one of said blocks between said channels; and
means for tightly securing said slidably mounted blocks around frame molding strips to clamp and form a frame.

9. The framing form and clamp of claim 8 wherein said means for tightly securing said slidably mounted blocks around frame molding strips includes a belt surrounding said blocks and a ratchet assembly connected to said belt for tightening said belt around said blocks.

10. The framing form and clamp of claim 9 wherein said belt is a web belt.

11. A framing form and clamp of claim 8 wherein said bracket comprises a Z-bracket.

12. A framing form and clamp, comprising:
a baseboard;
a plurality of channels in said baseboard;
blocks having bores extending the length of said blocks;
a bracket for slidably mounting at least one of said blocks in said channels;
attaching means for slidably mounting other of said blocks in said channels;
a belt surrounding said blocks; and
a ratchet assembly connected to said belt for tightening said belt around said blocks.

13. The framing form and claim of claim 12 wherein said attaching means includes an elongated threaded member and a slidable support in said channel wherein said member is inserted through the bores of said block and threadedly received in said support.

14. The framing form and clamp of claim 12 wherein said baseboard is a particle board with a mar resistant surface.

15. The framing form and clamp of claim 12 wherein said belt is a web belt.

16. The framing form and clamp of claim 12 wherein said blocks are three-quarter cylindrical blocks.

* * * * *